US009161581B2

(12) United States Patent
Huckabee et al.

(10) Patent No.: US 9,161,581 B2
(45) Date of Patent: Oct. 20, 2015

(54) CONFIGURABLE POCKET

(71) Applicant: Honeywell International Inc., Morristown, NJ (US)

(72) Inventors: Ruth Anne Huckabee, Dayton, OH (US); David Huckabee, Dayton, OH (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 14/460,423

(22) Filed: Aug. 15, 2014

(65) Prior Publication Data

US 2015/0047093 A1 Feb. 19, 2015

Related U.S. Application Data

(60) Provisional application No. 61/866,427, filed on Aug. 15, 2013.

(51) Int. Cl.
*A41D 27/20* (2006.01)

(52) U.S. Cl.
CPC ..... *A41D 27/201* (2013.01)

(58) Field of Classification Search
CPC ..... A41D 13/0015; A41D 27/20
USPC ..... 2/69, 247, 249, 250, 252, 253
See application file for complete search history.

(56) References Cited

U.S. PATENT DOCUMENTS

| | | | | | |
|---|---|---|---|---|---|
| 780,720 | A | * | 1/1905 | Keeley | 2/250 |
| 1,342,168 | A | * | 6/1920 | Gunderson | 2/253 |
| 1,708,786 | A | * | 4/1929 | Cohen | 2/247 |
| 2,339,322 | A | * | 1/1944 | Eisner | 2/93 |
| 2,358,137 | A | * | 9/1944 | Bard et al. | 2/247 |
| 3,334,357 | A | * | 8/1967 | Stults | 2/247 |
| 3,564,615 | A | * | 2/1971 | Jacobson | 2/247 |

* cited by examiner

*Primary Examiner* — Tejash Patel
(74) *Attorney, Agent, or Firm* — Wood, Phillips, Katz, Clark & Mortimer

(57) ABSTRACT

A garment having an outer shell with a pocket having a height below a top opening to the pocket and a width between pocket sides. An extender has opposite sides secured to the shell whereby the extender is adjacent the pocket opening, and the extender opposite sides are substantially aligned with the pocket sides. A first releasable connection is above the pocket opening between the extender and the shell. When connected, the extender is adjacent the shell at the first releasable connection holds. When released, the extender and shell define an opening substantially aligned with the pocket top opening.

12 Claims, 7 Drawing Sheets

CONFIGURABLE POCKET

CROSS-REFERENCE TO RELATED APPLICATIONS

This application claims the benefit of the filing date of U.S. Provisional Application No. 61/866,427 filed Aug. 15, 2013, which is hereby incorporated by reference.

FEDERALLY SPONSORED RESEARCH OR DEVELOPMENT

Not Applicable.

MICROFICHE/COPYRIGHT REFERENCE

Not Applicable.

FIELD

This application discloses various embodiments relating generally to equipment pockets for emergency personnel.

BACKGROUND

Firefighters come in different shapes and sizes, and therefore each firefighter typically has an assigned set of firefighting apparel, which may be custom fit to his/her figure. This ensures that firefighters can don and doff their protective garbs quickly and easily in emergency situations, and ensures that the protective apparel will not unnecessarily hinder movement of the firefighters when working in stressful and dangerous conditions.

Further, firefighters and other emergency personnel often use sophisticated technical equipment to assist them in their professional duties, such as radio equipment which enables them to speak to a dispatcher, to a commander, or to a colleague, with such equipment often carried on the person's garment in a manner whereby it can be easily accessed when needed. Emergency personnel may be active during duty. Fighting fires can be a vigorous activity. While moving vigorously, a firefighter doesn't want to lose his/her electronic communications equipment.

Such equipment comes in many different sizes and shapes, with electronic equipment seeming to get smaller and yet more sophisticated as technology develops. Yesterday's cell phones, for example, were often bulky and heavy but today's cell phones are relatively small and light. Firefighting equipment has similarly evolved as has other electronic equipment used by emergency personnel.

Moreover, particularly since technology is changing so quickly, as a practical and economic matter it is not feasible to provide the emergency personnel with new garments for carrying the equipment with each change to an item of new equipment. As a result, new equipment is often carried in pockets which were not designed to carry equipment having the size of the latest equipment. This can be an obvious problem in the relatively infrequent instance when the new equipment is bigger and will not fit in the intended pocket on the garment. However, this can also be a problem in the more common instance when the new equipment is smaller. That is, even though a smaller item may fit in a larger pocket, the equipment item may shift around in the pocket, with such movement potentially causing, for example, radio dials or buttons to be undesirably changed or pushed as the radio slides against walls of the pocket. Further, fishing the item out of a pocket can be made more difficult when the smaller item is deep in a pocket and hard to reach, particularly for emergency personnel who may be wearing gloves.

SUMMARY

In one aspect of the disclosed embodiment, a garment is provided having a garment outer shell with a pocket having a selected height H1 below a top opening to the pocket, and a width W between pocket sides. An extender has opposite sides secured to the shell whereby the extender is adjacent the pocket opening, and the extender opposite sides are substantially aligned with the pocket sides. A first releasable connection is above the pocket opening between the extender and the shell. When connected, the extender is adjacent the shell at the first releasable connection holds. When released, the extender and shell define an opening substantially aligned with the pocket top opening.

In one form of this aspect of the disclosed embodiment, a flap is secured to the shell above the extender, and a second releasable connection is provided between the flap and the pocket whereby when connected the flap is disposed over the extender and the pocket opening.

In another form of this aspect of the disclosed embodiment, the extender opposite sides bias a front panel away from the garment outer shell, where the front panel extends between the extender sides and has a width substantially equal to W.

In still another form of this aspect of the disclosed embodiment, the extender has a height H2 whereby when the first releasable connection is released, the pocket and the extender together define an extended pocket having a height of about H1+H2.

In yet another form of this aspect of the disclosed embodiment, the first releasable connection is a hook and loop connection.

In another form of this aspect of the disclosed embodiment, the pocket sides and the extender sides are flexible whereby a gap may be formed between the pocket and the extender for direct access through the gap to the pocket.

In another aspect of the disclosed embodiment, a garment is provided having a garment outer shell having a pocket defined thereon by a front panel secured along three sides to the garment shell by a pair of side panels and a bottom panel. The front panel and side panels at their top defining a top opening to the pocket with the garment outer shell, with the top opening being spaced a height H1 from the bottom panel. The front panel and the bottom panel have a width W between the pocket side panels. An extender has a front panel having a width substantially equal to W with two side panels secured to the shell above the pocket side panels whereby the extender is adjacent the pocket opening, and the extender opposite sides are substantially aligned with the pocket sides. A first releasable connection is above the pocket opening between the extender and the shell whereby when connected, the extender front panel is disposed adjacent to the shell at the first releasable connection and, when released, the extender front panel is spaced from the shell with the extender front and side panels and the shell defining an opening substantially aligned with the pocket top opening.

In one form of this aspect of the disclosed embodiment, a flap is secured to the shell above the extender, and a second releasable connection is provided between the flap and the pocket whereby when connected the flap is disposed over the extender and the pocket opening.

In another form of this aspect of the disclosed embodiment, the extender side panels bias the extender front panel away from the garment outer shell.

In still another form of this aspect of the disclosed embodiment, the extender has a height H2 whereby when the first releasable connection is released, the pocket and the extender together define an extended pocket having a height of about H1+H2.

In yet another form of this aspect of the disclosed embodiment, the first releasable connection is a hook and loop connection.

In another form of this aspect of the disclosed embodiment, the pocket side panels and the extender side panels are flexible whereby a gap may be formed between the pocket and the extender for direct access through the gap to the pocket.

Other features and advantages will become apparent from a review of the entire specification, including the appended claims and drawings.

BRIEF DESCRIPTION OF THE DRAWINGS

Like reference symbols in the various drawings indicate like elements.

DETAILED DESCRIPTION

An exemplary embodiment of a configurable pocket 10 on the outer surface of a garment shell 14 is illustrated in FIGS. 1-7. (As used herein, "garment shell" includes any material having an outer surface, wherein the pocket may be secured to that outer surface.)

Figure 5:
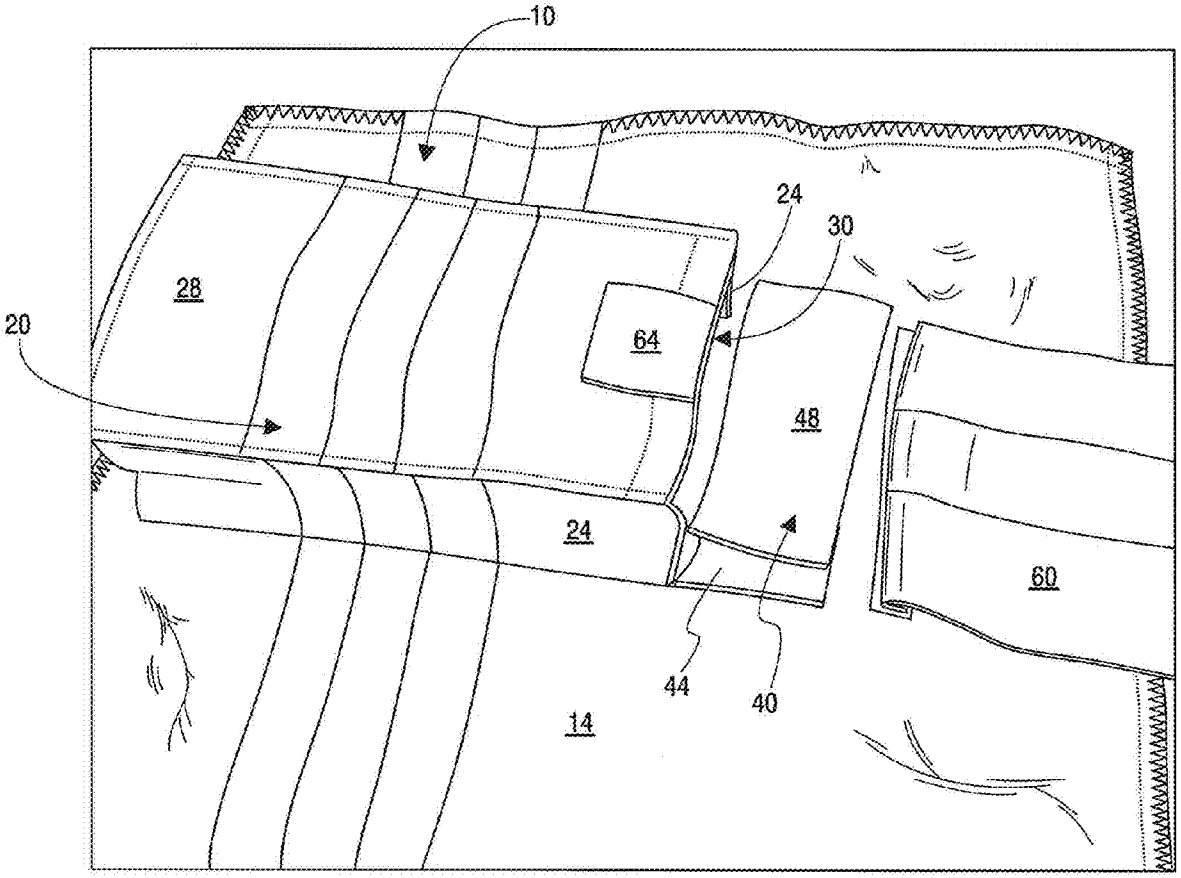
FIG. 5 is a perspective view of the exemplary configurable pocket in a stowed mode.
Figure 6:
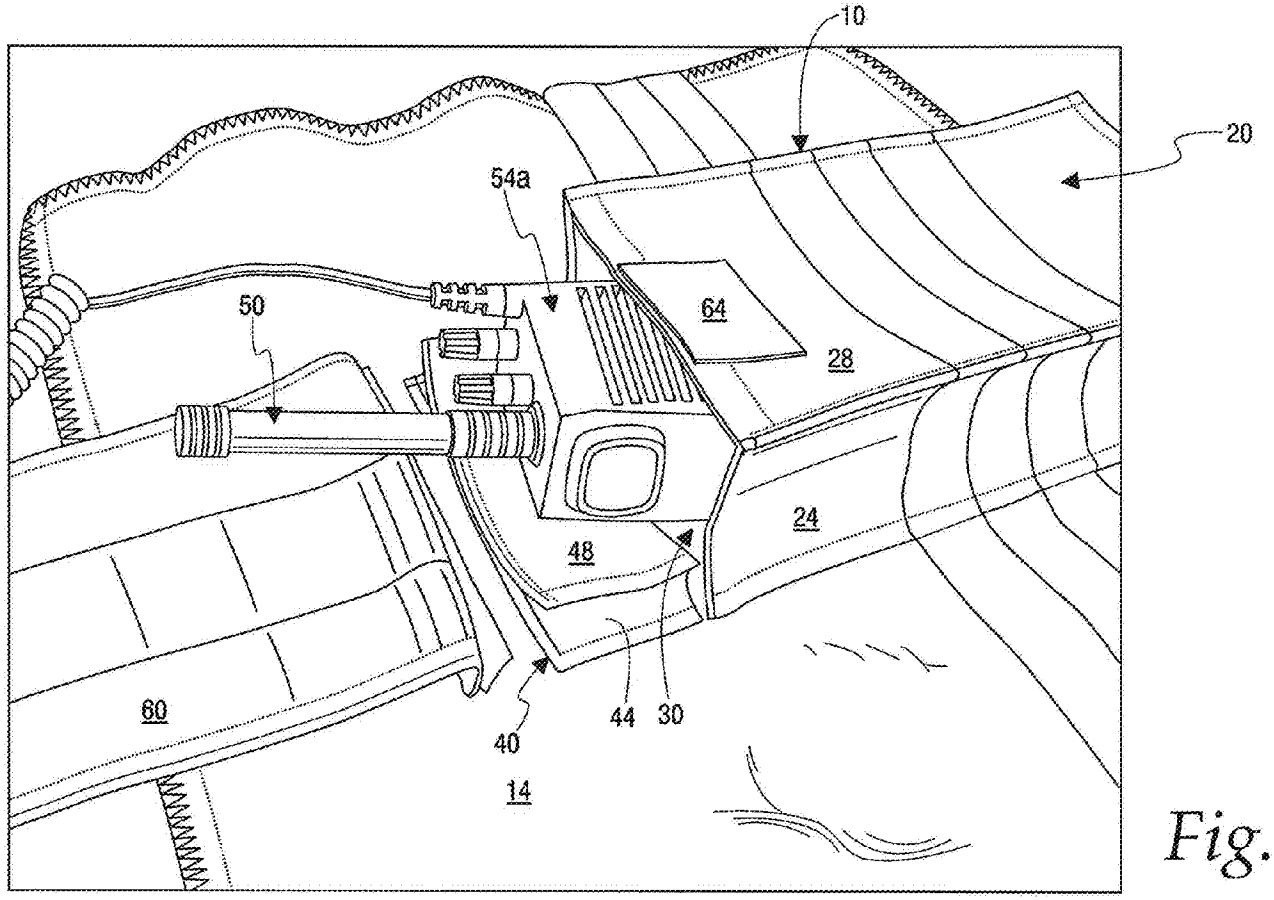
FIG. 6 is a perspective view similar to FIG. 5 showing a radio partially inserted in the exemplary configurable pocket.
Figure 7:
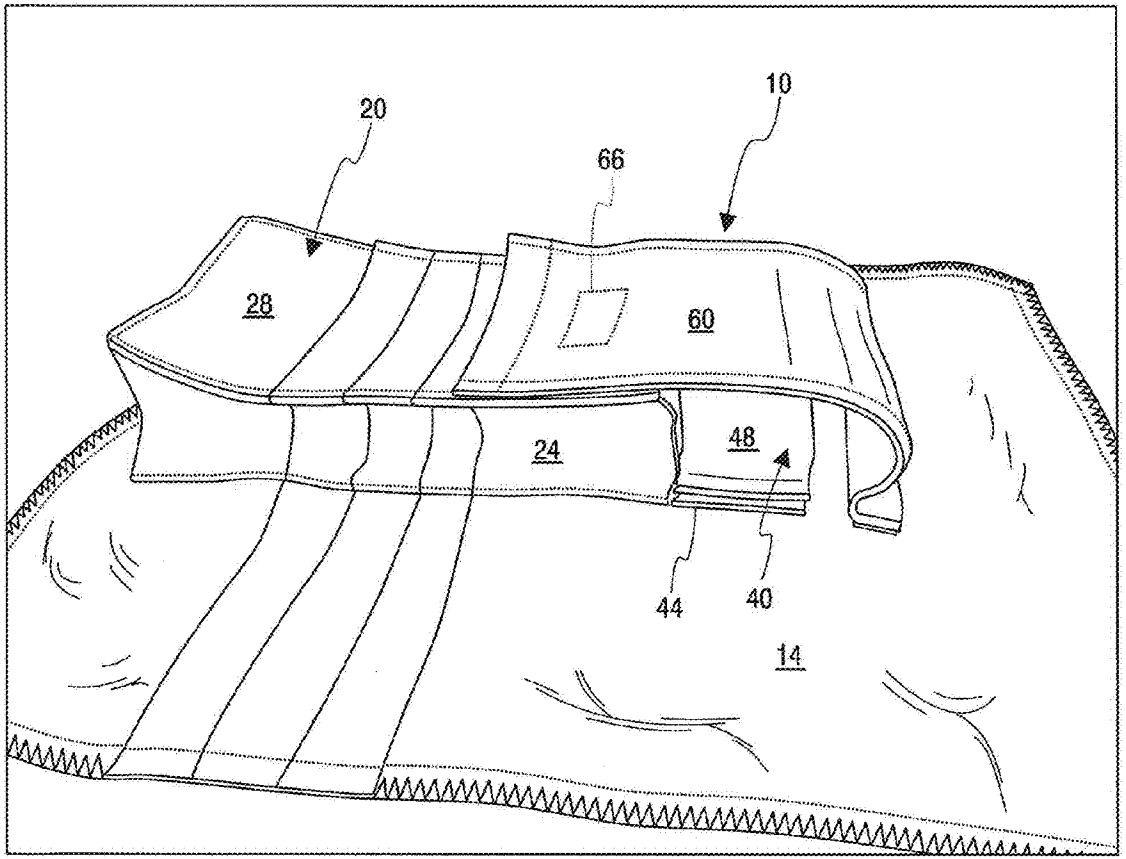
FIG. 7 is a perspective view of the exemplary configurable pocket with the pocket extender in a stowed mode and with an exemplary pocket cover closed over the pocket.

The illustrated configurable pocket 10 includes a fixed pocket 20 where the back of the pocket 20 is adjacent the outer surface of the garment shell 14, the fixed pocket 20 being further defined by two side panels 24, a bottom panel 26 and a front panel 28 defining a top opening 30 (see particularly FIGS. 5-7). A drainage hole or opening 34 (see FIGS. 4A and 48) may be advantageously provided in the bottom of the fixed pocket 20 to facilitate the draining of water that inadvertently enters the fixed pocket 20. The side panels 24 and bottom panel 26 may be sized to provide a desired depth (i.e., the space between the front panel 28 and the back of the pocket 20 adjacent the outer surface of the garment shell 14), with the side panels 24 and front panel 28 sized to provide a desired pocket height, and the bottom panel 26 and front panel 28 sized to provide a desired pocket width.

The pocket 10 also includes a pocket extender 40 having two side panels 44 and a front panel 48, with the side panels 44 secured to the garment shell 14 so as to be substantially in alignment with the connection of the side panels 24 of the fixed pocket 20 to the garment shell 14. Advantageously, the height of the extender side panels 44 may be substantially the same as the height of the fixed pocket side panels 24 (and the bottom panel 26), and the front panel 48 may be substantially the same width as the fixed pocket front panel 28 so that, when in a deployed mode as described herein, the side panels 24, 44 will be substantially aligned with each other as will the front panels 28, 48.

The pocket extender 40 may have a deployed mode (FIGS. 1-4A) and a stowed mode (FIGS. 4B-7).

In the deployed mode, the pocket extender 40 has its front panel 48 spaced from the garment shell 14 to define apertures at both the top and bottom whereby the pocket extender 40 combines with the fixed pocket 20 to define a pocket height (i.e., the distance from the bottom panel 26 to the aperture at the top of the pocket extender 40) which is substantially the combined height of the fixed pocket 20 and the pocket extender 40. It should be appreciated that the pocket extender side panels 46 may advantageously be of a material sufficiently stiff to generally support the extender front panel 48 away from the garment shell 14.

Figure 1:
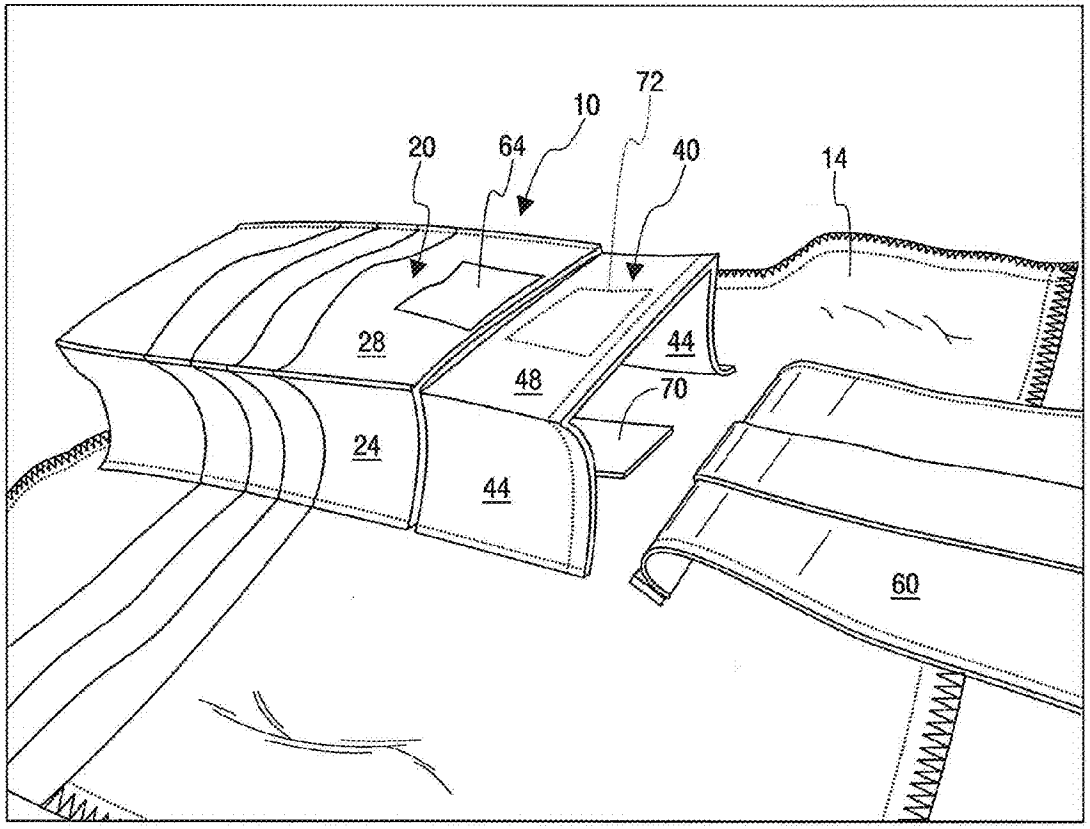
FIG. 1 depicts a perspective view of an exemplary configurable pocket on a garment.
Figure 2:
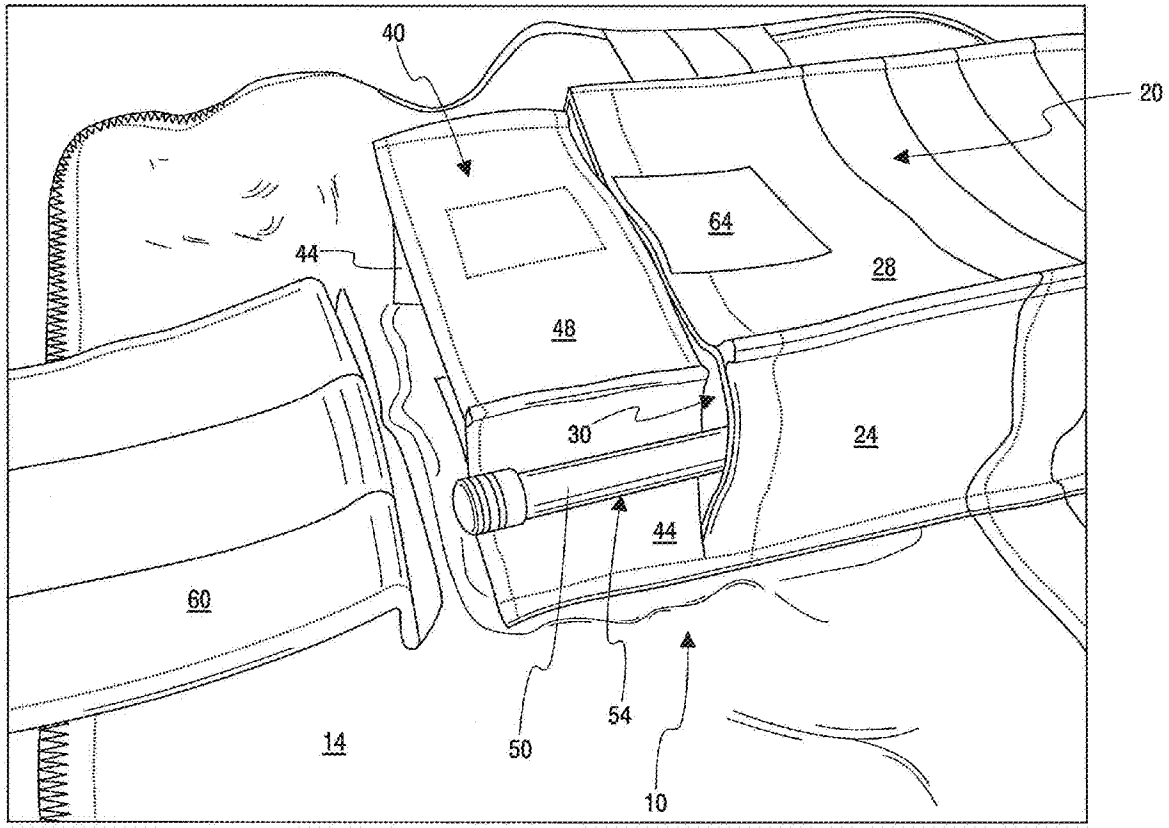
FIG. 2 is a perspective view of a radio stored in an exemplary configurable pocket with an antenna projecting between a fixed pocket and a pocket extender.

Moreover, it should be appreciated that while providing a substantially continuous pocket with an extended height while in the deployed mode, a gap may be provided between the fixed pocket 20 and pocket extender 40 whereby equipment stowed within the pocket 10 may extend through that gap. For example, as illustrated in FIG. 2, an antenna 50 of a radio 54 in the pocket 10 may be extended through that gap. Such antenna position might provide improved reception/transmission (if, e.g., being enclosed in the pocket would interfere in some manner with reception/transmission). Moreover, it should be appreciated that such antenna (or microphone wire) position may better secure the radio 54 within the pocket 10.

A top flap 60 may also be advantageously secured to the garment shell 14 above the pocket extender 40, which flap 60 may be releasably secured over the top pocket opening by, for example, a hook and loop connector 64, 66 on the outside of the fixed pocket front panel 28 and the inside of the flap 60 (see FIG. 3) to further facilitate retention of the equipment in the pocket 10.

In the stowed mode (see FIG. 4B), the pocket extender 40 may advantageously have its front panel 48 releasably secured adjacent the garment shell 14 by, for example, a hook and loop connection 70, 72. It should be appreciated that the releasable connection 70, 72 may be of any suitable form strong enough to secure the front panel 48 adjacent the garment shell 14 notwithstanding the outwardly biasing force of the side panels 44 while also being readily releasable should a wearer choose to pull the pocket extender front panel 48 free to change to the deployed mode. A suitable snap connection could thus alternatively be advantageously used.

It should be appreciated that in the stowed mode, a pocket height consisting of only the height of the fixed pocket 20 is provided. Thus, if for example a wearer were assigned a new radio 54*a* smaller in size than a previous radio which fit in the extended pocket, the radio 54*a* would be more easily accessible with the pocket extender 40 out of the way in the stowed mode, which can be significant particularly for wearers such as firemen who may be working wearing gloves.

Figure 3:
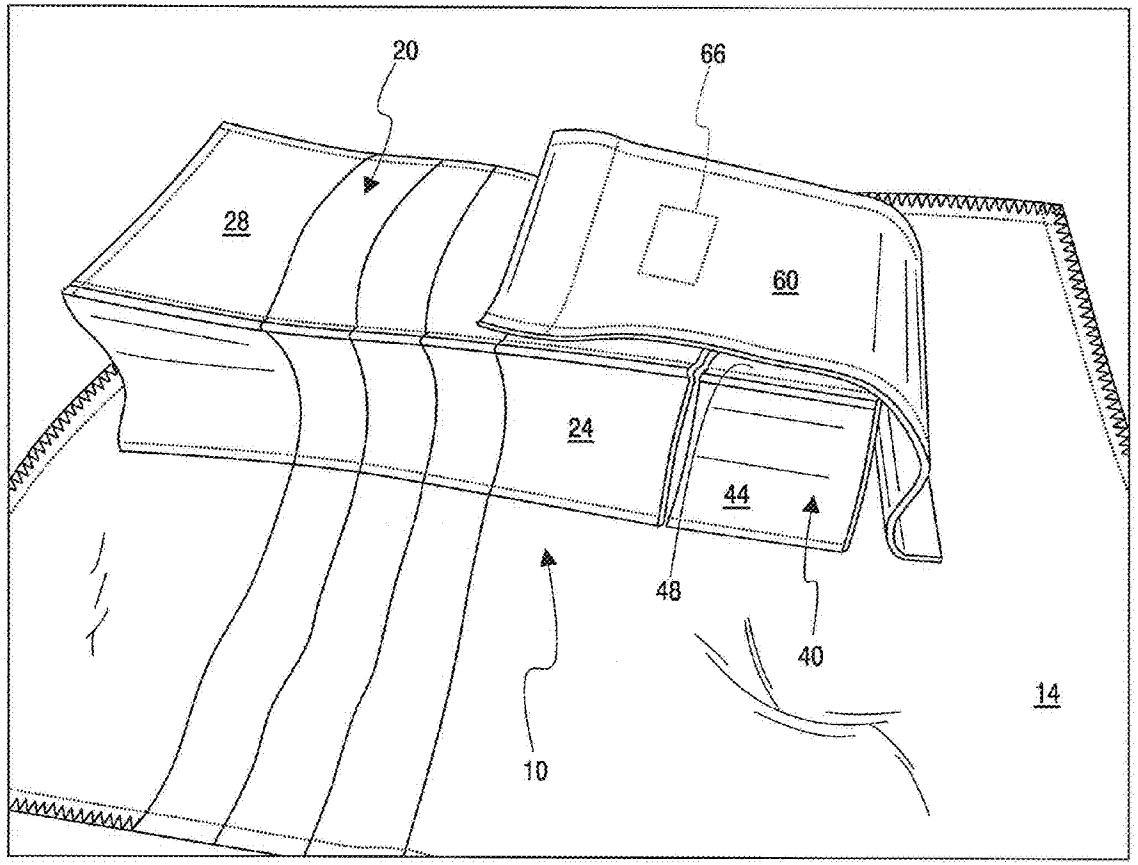
FIG. 3 is a perspective view similar to FIG. 1 with a pocket cover closed over the pocket.
Figure 4A:
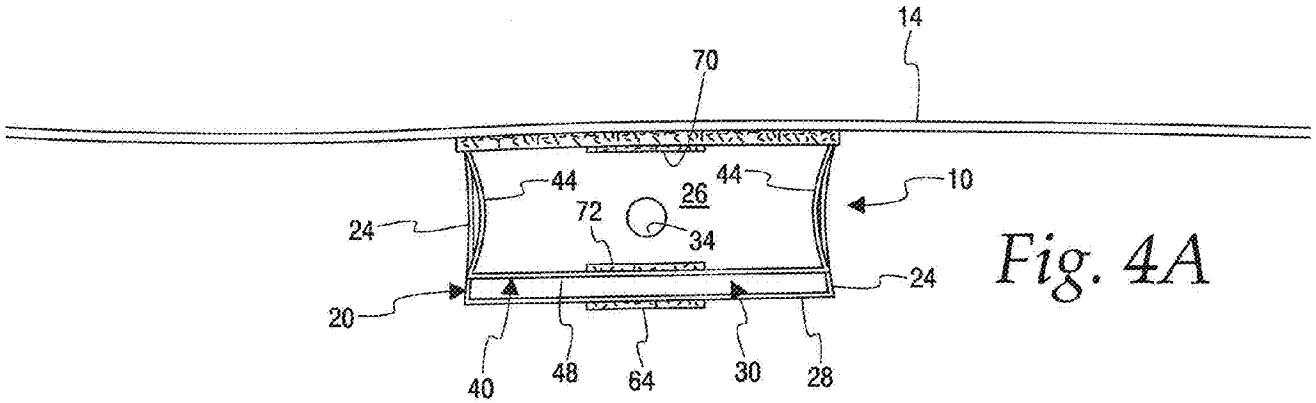
FIG. 4A is a perspective view looking into the FIG. 1 exemplary configurable pocket with the extender in a deployed mode.
Figure 4B:
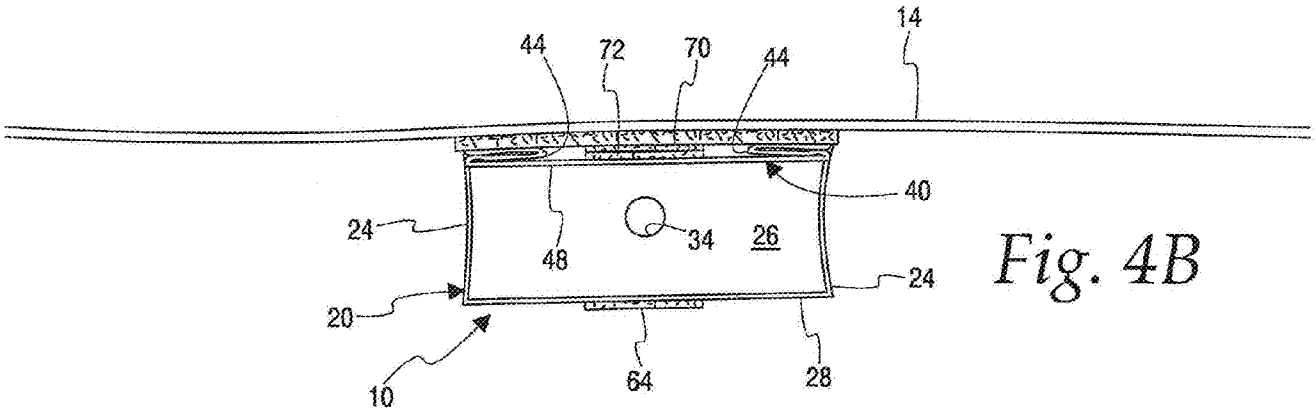
FIG. 4B is a perspective view similar to FIG. 4A but with the pocket extender in a stowed mode.

It should also be appreciated that even in the stowed mode, the stiffness of the extender side panels 44 may cause the sides of the pocket extender 40 to project up somewhat such as illustrated in FIG. 3. What such configuration will do little to block entry into the fixed pocket 20 (e.g., when putting a radio 54*a* into the fixed pocket 20), it should be appreciated that the extender side panels 44 may spring back up slightly after the equipment is placed in the fixed pocket 20 and thereby assist in retaining the equipment in the pocket 20 by partially blocking removal.

While the above described structure includes one pocket extender 40, it should be appreciated that two or more pocket extenders may be provided for a pocket 10, thereby increasing the variability of the pocket height. Where two pocket extenders are provided, a first pocket extender may be deployed to provide an effective pocket height that is larger than a height of a fixed pocket 20, and both the pocket extenders may be deployed to provide an effective pocket height that is larger to provide secure storage of an even larger device.

Although various embodiments have been described with reference to the Figures, other embodiments are possible. For example, some embodiments may use fixed pockets that have substantially no depth. Also, pant pockets are configured to form to the body dimension of the wearer, and pocket extenders may similarly be configured to conform to the body dimension of the wearer. Additionally, the pocket extenders may have dissimilar dimensions to those of the corresponding fixed pocket, and a plurality of pocket extenders may successively extend one or more pocket dimensions. Still further, a plurality of pocket extensions may be stacked one upon another whereby each pocket extension, for example may flatten when stowed upon a larger extension beneath it.

It should also be appreciated that pockets 10 such as described may used with a variety of garments or clothing articles, such as jackets and pants.

Further, entire pockets consistent with the structure disclosed herein may be deployable. For example a small pocket may be located on a larger pocket, each with releasable securing elements for selective deployment (where, e.g., a small pocket may be deployed or stowed independent of the larger pocket's deployment underneath).

In addition to the various possible functional advantages of the pocket 10 described herein, it should also be appreciated that the adjustability of the pocket height can extend the useful life of the garment with which the pocket is used. For example, if a firefighter is issued a new radio of a different size than the radio previously used, the firefighter can continue to use his previous jacket and adjust the pocket 10 to accommodate the new radio size without being forced to get a new jacket with an appropriate pocket (or work with the radio in the wrong size pocket, possibly resulting in a dangerous situation in which the firefighter cannot access or use the radio properly). Similarly, a fire department may, for example, be able to outfit a team of firefighters before having to commit to radio equipment, and/or the ability to accommodate different size equipment in a pocket may permit an emergency department to slowly replace a fleet of aging radios for example, without having to obtain new jackets or the expense of all the radios at one time.

The pocket extenders may also be sized to accommodate various predetermined sized devices, allowing different equipment to be stored in the pocket depending on the job and the wearer's needs. For example, a fixed pocket may be sized to tightly fit a small device, but with a single pocket extender, a different size device may also be tightly fit.

A number of implementations have been described. Nevertheless, it will be understood that various modification may be made. For example, advantageous results may be achieved if components of the disclosed systems were combined in a different manner, or if the components were supplemented with other components. Accordingly, other implementations are contemplated.

The invention claimed is:

1. A garment, comprising:

a garment outer shell having a pocket, said pocket having
- a selected height H1 below a top opening to said pocket, and
- a width W between pocket sides;

a pocket depth extender having opposite sides secured to said shell whereby
- said extender is adjacent said pocket opening, and
- said extender opposite sides are substantially aligned with said pocket sides; and a first releasable connection above said pocket opening between said extender and said shell whereby
- when connected, at said first releasable connection said extender is adjacent said shell, and
- when released, said extender and shell define an opening substantially aligned with said pocket top opening.

2. The garment of claim 1, further comprising:

a flap secured to said shell above said extender; and a second releasable connection between said flap and said pocket whereby when connected said flap is disposed over said extender and said pocket opening.

3. The garment of claim 1, wherein said extender opposite sides bias a front panel away from said garment outer shell, said front panel extending between said extender sides and having a width substantially equal to W.

4. The garment of claim 1, wherein said extender has a height H2, whereby when said first releasable connection is released, said pocket and said extender together define an extended pocket having a height of about H1+H2.

5. The garment of claim 1 wherein said first releasable connection comprises a hook and loop connection.

6. The garment of claim 1, wherein said pocket sides and said extender sides are flexible whereby a gap may be formed between said pocket and said extender for direct access through said gap to said pocket.

7. A garment, comprising:

a garment outer shell having a pocket defined thereon by a front panel secured along three sides to said garment shell by a pair of side panels and an bottom panel, said front panel and side panels at their top defining a top opening to said pocket with said garment outer shell, said top opening being spaced a height H1 from said bottom panel, and said front panel and said bottom panel having a width W between said pocket side panels;

a pocket depth extender having a front panel having a width substantially equal to W with two side panels secured to said shell above said pocket side panels whereby
- said extender is adjacent said pocket opening, and
- said extender opposite sides are substantially aligned with said pocket sides; and a first releasable connection above said pocket opening between said extender and said shell whereby
- when connected, at said first releasable connection said extender front panel is disposed adjacent to said shell,
- when released
  - said extender front panel is spaced from said shell, and
  - said extender front and side panels and said shell define an opening substantially aligned with said pocket top opening.

8. The garment of claim 7, further comprising:

a flap secured to said shell above said extender; and a second releasable connection between said flap and said pocket whereby when connected said flap is disposed over said extender and said pocket opening.

9. The garment of claim 7, wherein said extender side panels bias said extender front panel away from said garment outer shell.

10. The garment of claim 7, wherein said extender has a height H2, whereby when said first releasable connection is released, said pocket and said extender together define an extended pocket having a height of about H1 +H2.

11. The garment of claim 7, wherein said first releasable connection comprises a hook and loop connection.

12. The garment of claim 7, wherein said pocket side panels and said extender side panels are flexible whereby a gap may be formed between said pocket and said extender for direct access through said gap to said pocket.

* * * * *